US005280901A

United States Patent [19]

Smith et al.

[11] Patent Number: 5,280,901

[45] Date of Patent: Jan. 25, 1994

[54] SHEET VARIABLE CORRUGATING AND FEEDING NIP

[75] Inventors: Robin E. Smith; Kenneth G. Christy, both of Webster; Gary M. Foos, Williamson, all of N.Y.

[73] Assignee: Xerox Corporation, Stamford, Conn.

[21] Appl. No.: 36,608

[22] Filed: Mar. 24, 1993

[51] Int. Cl.[5] ..... B65H 29/70

[52] U.S. Cl. ..... 271/188; 271/209; 271/250; 271/252

[58] Field of Search ..... 271/188, 209, 161, 272, 271/250, 252

[56] References Cited

U.S. PATENT DOCUMENTS

| | | | |
|---|---|---|---|
| 3,861,673 | 1/1975 | Ticknor | 271/225 |
| 4,469,319 | 9/1984 | Robb et al. | 271/3.1 |
| 4,664,509 | 5/1987 | Christy et al. | 355/75 |
| 4,712,786 | 12/1987 | Looney | 271/207 |
| 4,733,857 | 3/1988 | Feldeisen et al. | 271/296 |
| 4,916,493 | 4/1990 | DeVito | 355/321 |
| 4,977,432 | 12/1990 | Coombs et al. | 355/309 |
| 5,016,060 | 5/1991 | Arai | 271/188 X |
| 5,145,168 | 9/1992 | Jonas et al. | 271/234 |
| 5,152,522 | 10/1992 | Yamashita | 271/188 X |
| 5,153,663 | 10/1992 | Bober et al. | 355/319 |
| 5,194,904 | 3/1993 | Ruch | 355/321 |

*Primary Examiner*—David H. Bollinger

[57] ABSTRACT

A sheet feeding and corrugating system, especially for output of image substrate sheets of a reproduction apparatus, wherein the sheets are fed in a normal path through a sheet feeding nip comprising plural spaced sheet feeding rollers. Both feeding and variable corrugating of flimsy or stiff sheets is provided by spherical balls freely mounted in generally vertical ball retainers providing for vertical movement and dual axis rotation against the sheet feeding rollers to define the sheet feeding nip and by additional similar balls (in additional similar ball retainers) intermediately of the feed rollers, which additional balls are unsupported vertically except by bottom-of-travel retainers so that these additional intermediate balls roll gravity-loaded against a sheet being fed through the nip to provide sheet corrugation varying automatically with the stiffness of the sheet, and are freely liftable up to the level of the nip by stiff sheets resisting corrugation. These balls may be readily added to or removed to independently increase or decrease the sheet nip and/or corrugation forces at their respective locations transverse the nip. A sheet side shifting mechanism can laterally offset the sheets in the same nip to eject offset, by moving only the sheet feeding rollers, without resistance from the stationarily mounted balls, all of which roll freely laterally as well in the normal feeding direction.

5 Claims, 3 Drawing Sheets

SHEET VARIABLE CORRUGATING AND FEEDING NIP

Disclosed is an improved system for sheet feeding, especially sheets of varying properties, including transparencies.

Proper and dependable sheet feeding is critical to dependable electrostatographic, ink jet or other reproducing machines, and more particularly, to the imaged copy sheets outputted by copiers and printers.

A particular problem with many prior types of sheet feeding exit configurations is that they do not provide effective corrugation of the sheet as it exits. While normal paper exits cleanly without corrugation, transparencies or very thin (e.g. Japanese) paper, having a much lower beam strength, do not always exit completely or stack properly.

There is disclosed herein a low cost and simple system for improved sheet feeding in which a desirable sheet corrugation for beam strength sheet feeding assistance desirably automatically varies with sheet stiffness. Yet, the system disclosed herein also accommodates contemporaneous sheet lateral realignment in the same apparatus. Another disclosed feature is the provision of simple changing of either the sheet feeding normal force or the sheet corrugating normal force.

Various types of corrugating sheet feeders are known in the art, including various patent disclosures. Noted merely as some examples are those in Xerox Corporation U.S. Pat. No. 5,153,663 issued Oct. 6, 1992, particularly disclosing conformable (deformable) rollers for variable sheet corrugation, and other art cited therein. An additional reference noted re variable sheet corrugation [in that case, varying with the document tray setting for document size], is the Fuji Xerox Corporation version of the Xerox Corporation "1075" recirculating document handler [RDH] as shown and described in Xerox Corp. U.S. Pat. No. 4,469,319 issued Sep. 4, 1984 to F. J. Robb, et al. Corrugation by the same, fixed amount of all of the output sheets, including transparencies, per se, with idler rollers, etc., is used in various copier products, but not, it is believed, in combination with lateral sheet movement for offsetting.

As to background re other art, ball-on-belt sheet transports allowing (planar) sheet lateral or side shift or rotation are known in the art for certain types of copy sheet output or other transports, e.g., Xerox Corporation U.S. Pat. Nos. 5,145,168 issued Sep. 8, 1992 to R. R. Jonas, et al., 4,733,857 issued Mar. 29, 1988 to R. F. Feldeisen, et al.; and 3,861,673 issued Jan. 21, 1975 [note the balls-on-balls 22 of this U.S. Pat. No. 3,861,673 sheet rotator transport, as in FIG. 4]. Also noted is Xerox Corporation U.S. Pat. No. 5,145,168, issued Sep. 9, 1992.

Especially as xerographic and other copiers and printers increase in speed, and become more automatic, it is increasingly important to provide higher speed yet more reliable and more automatic handling of the copy sheets. It is desirable to reliably feed and accurately register sheets of a variety or mixture of sizes, types, weights, materials, conditions and susceptibility to damage. Smearable ink jet printer ink, fuser oil or other materials thereon susceptible of smearing or contamination of other documents by the feeding process is also a problem. The images on sheets, and/or their fusing, especially in duplex (two sided) printing or color (plural toner layer) printing, can change the sheet shape, curl, or other feeding characteristics. Also, the images themselves may be subject to damage in feeding if not properly handled. Avoidance of undesired sheet skewing during feeding, and maintaining proper registration and non-slip feed timing of sheets is also important. Misregistration, especially skewing, can adversely affect further feeding, ejection, and/or proper stacking of the sheets, even with slower copying rate copiers. Customers expect copy sheets to exit cleanly, without jamming, and stack neatly.

A specific feature of the specific embodiment(s) disclosed herein is to provide an improved sheet feeding and corrugating system for image substrate sheets of a reproduction apparatus, wherein the sheets are fed in a normal path through a sheet feeding nip comprising plural, spaced, sheet feeding rollers, the improvement for both feeding and variably corrugating flimsy or stiff sheets comprising: spherical balls freely mounted in generally vertical ball retainers providing for vertical movement and dual axis rotation against said sheet feeding rollers to define said sheet feeding nip; additional spherical balls in additional generally vertical ball retainers positioned intermediately of said sheet feeding rollers for engagement of a sheet in said nip with said additional balls; said additional spherical balls being unsupported vertically except by said additional ball retainers having bottom retainers preventing said additional balls from dropping fully out of the bottom of said additional ball retainers, so that said unsupported additional balls are rolling gravity loaded by the weight of said additional balls against a sheet being fed through said sheet feeding nip to provide intermediate sheet corrugation forces with the extent of sheet corrugation varying automatically with the stiffness of the sheet being fed.

Further specific features provided by the system disclosed herein, individually or in combination, include those wherein the maximum extent of sheet corrugation is limited by said bottom retainers; and/or wherein said additional balls mounted in said additional ball retainers are freely liftable therein up to substantially the level of said nip by stiff sheets resisting corrugation to provide self-limiting of stiffer sheets corrugation and no substantial resistance to sheet feeding; and/or wherein said additional ball retainers provide for readily independently adding or removing said additional spherical balls therein, to independently increase or decrease the sheet corrugation force at those respective locations transverse said nip; and/or further including a sheet side shifting mechanism for laterally offsetting the sheets from said normal path through said nip so as to eject the sheets from said nip offset from said normal path, comprising moving said sheet feeding rollers relative to said normal path without resistance from said spherical balls or said additional spherical balls, all of which balls roll freely laterally as well as rolling freely in said normal path direction.

In the description herein the term "sheet" refers to a usually flimsy sheet of paper, plastic, or other such conventional individual image substrate. The "copy sheet" may be abbreviated as the "copy". A "job" is a set of related sheets, usually a collated copy set copied from a set of original document sheets or electronic page images from a particular user or otherwise related.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of these embodiments thereof, including the drawing figures (approximately to scale) wherein:

Figure 1:
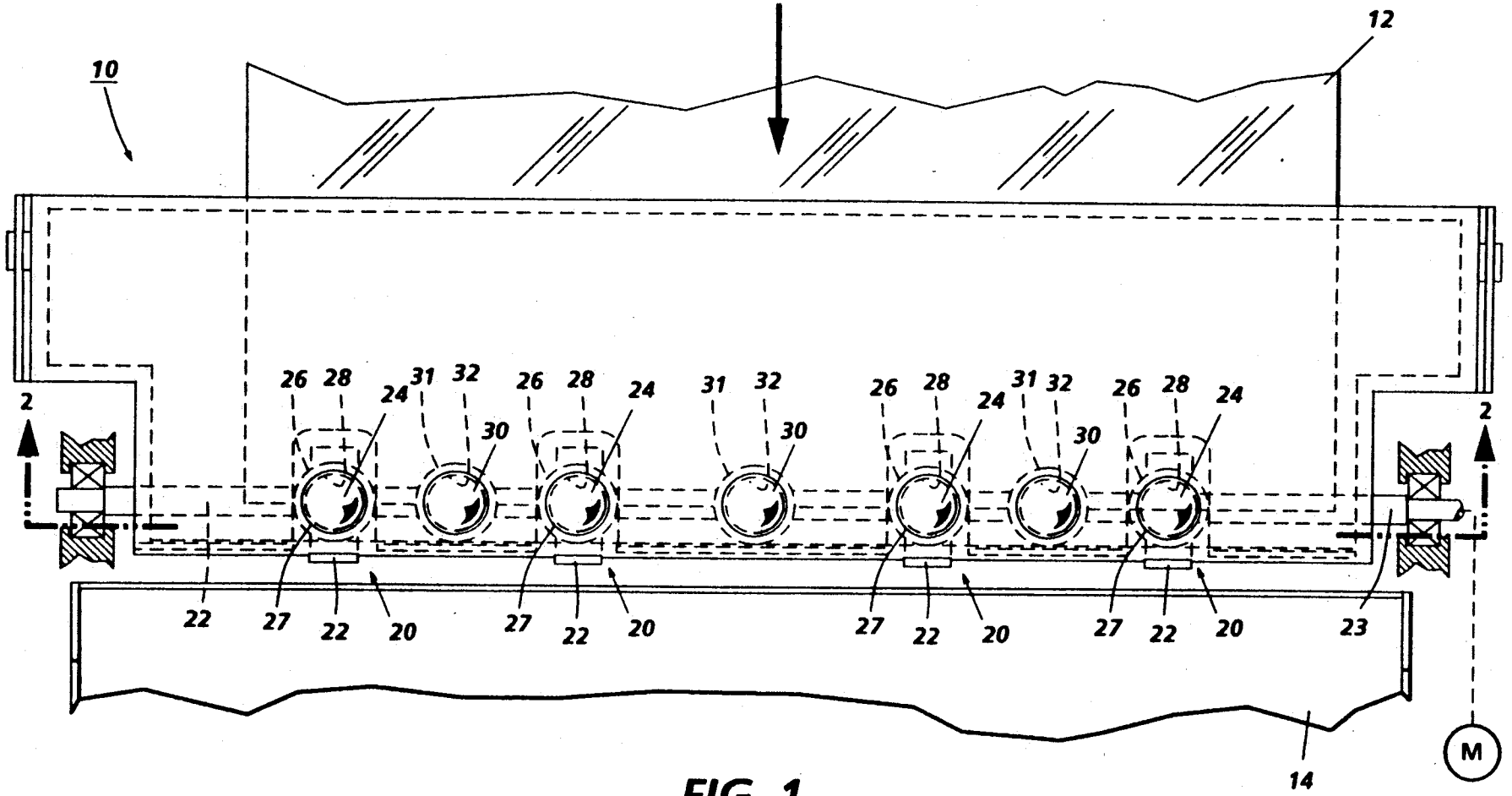
FIG. 1 is a top view of one embodiment of the disclosed system.
Figure 2:
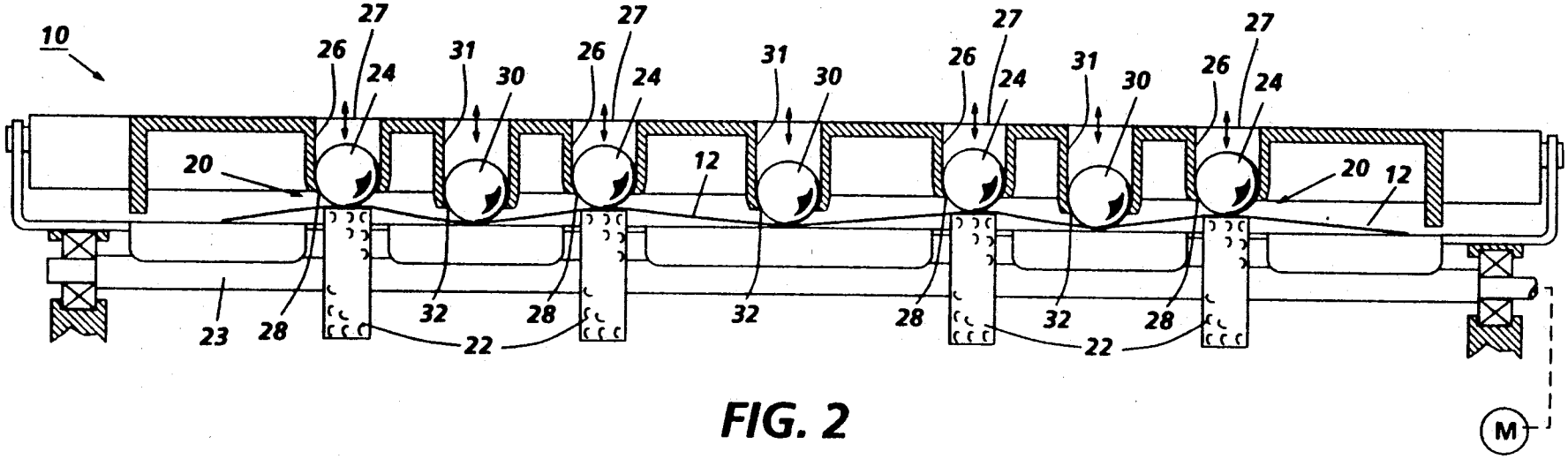
FIG. 2 is a frontal elevational view of the embodiment of FIG. 1 showing its corrugation and feeding of a normal (thin) sheet.
Figure 3:
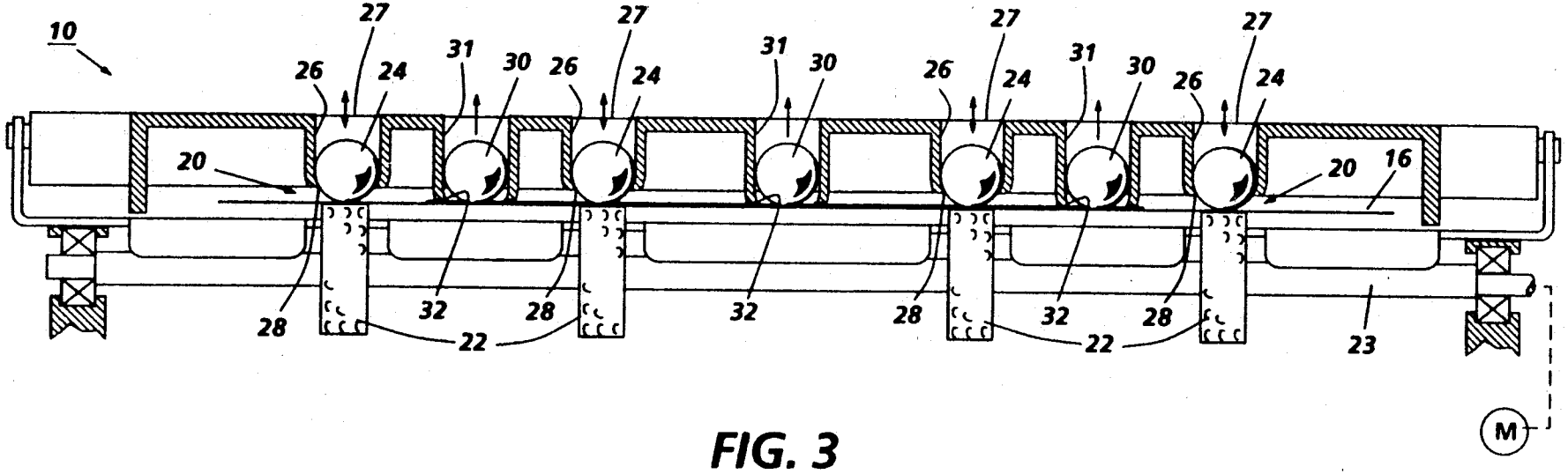
FIG. 3 shows the same apparatus in the same view as FIG. 2, but showing uncorrugated feeding of a very stiff sheet.
Figure 4:
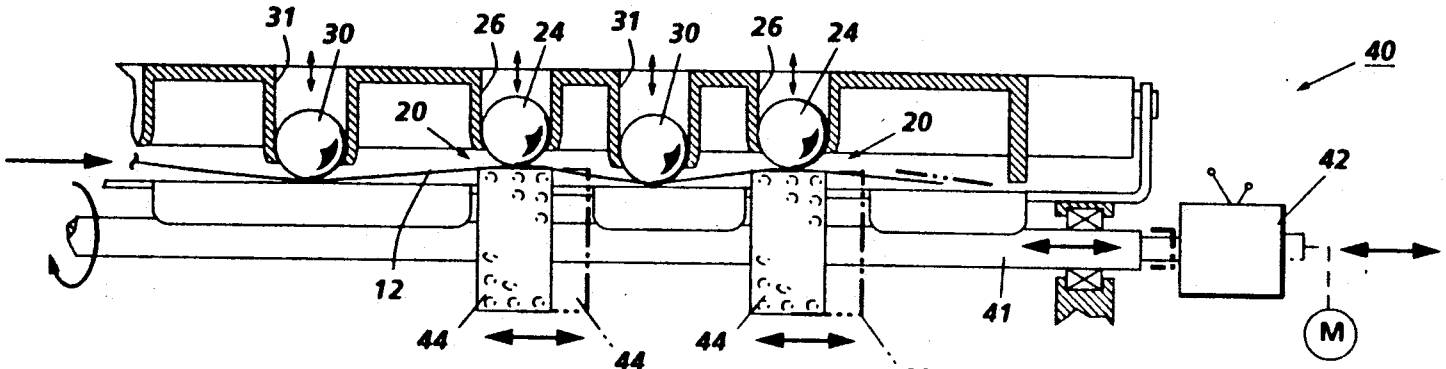
FIG. 4 is a partial front elevational view of a similar but alternative embodiment shown providing selective automatic side shifting of a sheet in the feeding nip for offset stacking of sheets.
Figure 5:
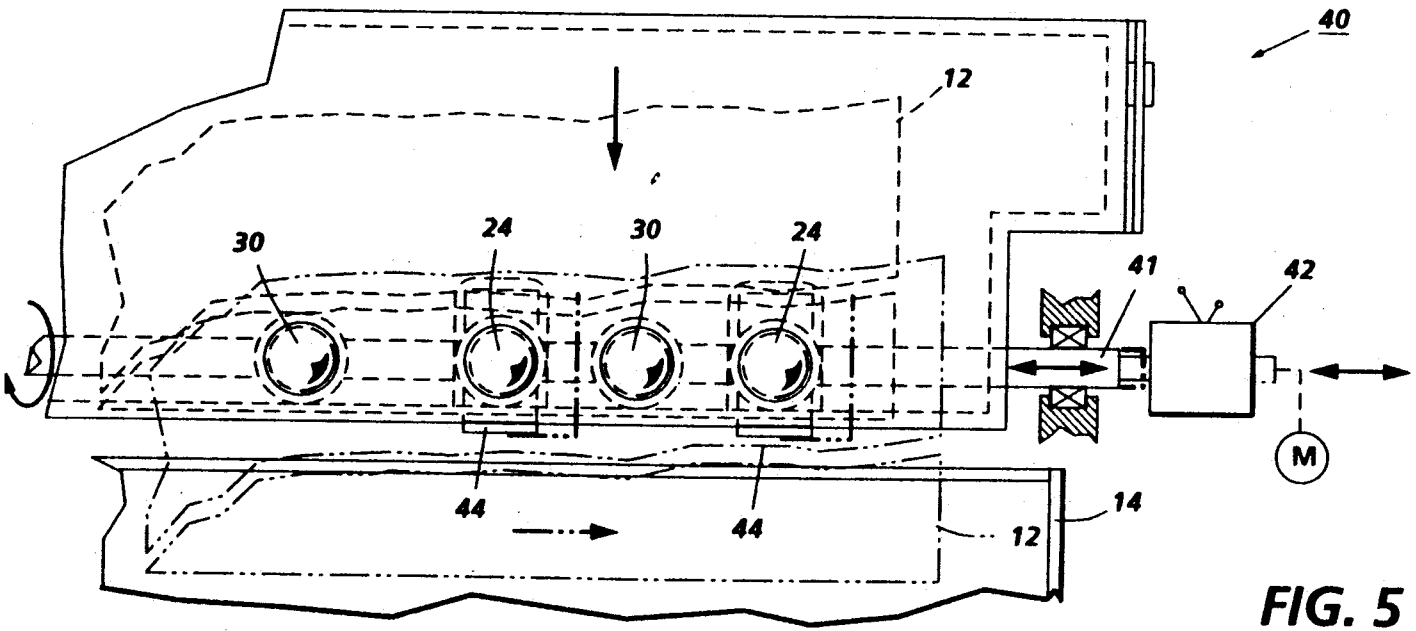
FIG. 5 is a top view of the embodiment of FIG. 4.

Describing now in further detail the exemplary embodiments with reference to the Figures, there is shown in FIGS. 1-3 an exemplary sheet feeding and corrugation system 10 by way of one example thereof, and a similar system 40 is shown in FIGS. 4-5. Only the sheet feeders 10 and 40, per se, need be illustrated, since they would normally be at one end or side of a printer or copier, which is otherwise conventional, or in an otherwise conventional sorter or interface module, and thus not requiring further illustration or discussion here.

A transparency sheet 12 (or other thin sheet) is shown in FIGS. 1 and 2 being fed by feeder system 10 to an exemplary output bin or tray 14, (partially shown in FIG. 1). A much stiffer sheet 16 is shown being similarly fed by the same system in FIG. 3. The exemplary four (it could be more or less) spaced apart sheet feeding nips 20 here are defined by four identical conventional foam rubber frictional sheet feeding rollers 22 under the sheet path, driving the bottom of the sheet in the nip. The feed rollers 22 may be as shown, all conventionally mounted [or may be semi-independently pivotally mounted as discussed below] on a common feed shaft 23 with conventional slidable end bearings, which shaft 23 is rotatably driven by a motor "M". As shown most clearly in FIG. 3, these nips 20 here may all desirably be (and remain) in the same plane, with the feed rollers 22 remaining same basic diameter (with little or no deformation) for consistent feeding surface velocities.

The opposing members forming the other (opposing) sides of the sheet feeding nips 20 here are metal or other weighted spherical balls 24, riding on top of the rollers 22 to provide the nip 20 normal force. That is constantly provided, since the balls 24 are free to move vertically within generally vertical cylindrical ball retaining tubes 26 of a slightly larger interior diameter than the balls 24, and providing low friction relative to the balls 24. These retainer tubes 26 provide lateral confinement but free vertical movement and free rotation. They are open at their tops 27 and bottoms. However, the bottoms of the ball retainer tubes 26 have and are defined by reduced internal diameter retaining lips or seats 28 so that the balls 24 can extend up to nearly half-way out of the bottoms of the tubes 26, but not drop any further (not fall out). The orientation of the components is such that the balls 24 are not normally ever seated on these seats or lips 28, they are normally riding on top of the outer, feeding, surfaces of their respective feed rollers 22 at all times. Note that these balls 24 do not provide corrugation, they provide feeding normal force for their mating feed rollers 22. They do, however, allow for lateral sheet movements caused by sheet corrugation in the same nip.

As also shown, similar or identical plural balls 30 are similarly mounted in similar retaining tubes 31 with open tops. However, these are located intermediately of, and alternating with, the rollers 22 and balls 24, approximately equidistantly between the nips 20. These other balls 30 do not form any feeder nips. They are not opposed by any rollers or other supports. (Furthermore, if desired, the bottom retaining lips or seats 32 of these tubes 31 may be lower than the retainer seats 28 of tubes 26.) Thus, unresisted movement of the balls 30 by gravity is allowed down within tubes 31 to about 3 mm or so below the plane of the nips 20 defined by rollers 22 and balls 24. This allows each of the balls 30 to independently weigh down its area of the sheet 12 between nip areas and plurally or "wave" corrugate the sheet 12, as shown in FIG. 2. Yet, the balls 30 are readily pushed up within their respective retainer tubes 31 by a stiff sheet such as 16 resisting (and not needing) corrugation, as shown in FIG. 3.

Turning now to the embodiment 40 of FIGS. 4 and 5, it is only slightly different, so only the differences need be noted here. Here, the drive shaft 41 is slightly axially shiftable by a solenoid 42 when a sheet is in the nip to provide desired lateral sheet offsetting, e.g., about 2 cm or 25 mm transverse the sheet feeding output path through the nip. Note the illustrated movement arrows. To maintain the feed nip during such side shifting, slightly wider feed rollers 44 may be provided as compared to the feed rollers 22 of the other Figures.

It is important to note that only the shaft 41 and rollers 44 need move for side shifting. All the balls 24 and 30 and their retainers 26 and 31 can be the same, and remain stationary, just as in the system 10. Since all the balls freely rotate in any direction, they do not resist this side shifting of the feed rollers 44 or the sheet shifted therewith. Normal forces for feeding and corrugation by the balls 24 and 30 are not interrupted either. Thus, as shown in FIGS. 4 and 5, selected side shifting can be provided simply by a simple solenoid 42 axially moving that shaft 41 by the amount desired to offset the outputted job stacks, e.g., about 2 cm or 25 mm.

In both embodiments 10 and 40, it will be generally noted that since all the idlers are all ball rollers, that no idler shaft, idler rollers, idler shaft floating end bearings, spring loadings, or idler shaft alignment re the drive rollers or drive shaft is required, yet the normal force required to form a feeding nip is provided. Since the balls are free to roll laterally as well as forward, unlike rollers, this also means that no idler rollers or idler shaft translation is required to allow sheet output to be laterally side shifted for lateral job offsetting. Only the single shaft of the drive (feed) wheels needs to be slightly lateral shifted [or pivoted].

Note, in contrast, as to other side shifting systems, Xerox Corporation U.S. Pat. Nos. 4,712,786 issued Dec. 5, 1987; and 4,916,493 issued Apr. 10, 1990 to G. M. DeVito; and U.S. Ser. No. 07/940,933 by Thomson and Theobald entitled "Sheet Feeding System with Lateral Registration" filed Sep. 4, 1992. Also, Gradco Systems, Inc. U.S. Pat. No. 4,977,432 issued Dec. 11, 1990. Also, other side shifting art cited in those patents and that application. Details of side shifting mechanisms disclosed therein may, in part, be incorporated and/or alternatively used here to the extend consistent with the advantages of the disclosed system.

By way of further background re other known and alternative prior side shifting systems for offsetting which can be substantially improved with the present system, some parts of the Gradco Japan Inc. "Midi-II" sorter (sold for several years) are in common with those Xerox Corporation "5775" color digital copiers which are equipped with sorters. The Midi-II has job set offsetting in a manner allegedly patented, although a patent number is not presently known to the Applicants. To briefly describe that particular type of offsetting, as understood, the sheet offsetting is by automatically slightly pivoting the sheet exit feed rollers from their normal position, for alternate jobs. This is accomplished by having each feed roller independently mounted to the common drive shaft on a semi-spherical bearing (known per se) which allow the feed rollers to be tilted (rotated) non-perpendicularly to their drive shaft, yet still be rotatably driven by that drive shaft. Titling or steering the feed rollers axes is accomplished by "U" shaped yokes. Each side of each yoke closely engages and holds opposing lower side surfaces of one feed roller. Each yoke is pivotable about a vertical central axis by a solenoid, which is connected (ganged) to pivot all the yokes together by the same amount. This pivots all the feed wheels together. That is done when a sheet is well into the nip, and it causes the sheet to feed somewhat transversely to its normal feed direction, and thus eject and stack in a slightly offset forward position from that of a normal feed path (which is with the feed rollers fully perpendicular their drive shaft). By operating this yoke feed wheel pivoting system automatically for every other (alternate) job sheet set, plural jobs can be offset from one another in adjacent output bins of the sorter. Alternatively, if all jobs are being stacked in the (higher capacity) top (open) bin, each commonly stacked job set there will be alternately slightly offset from the next job, for ease of job separation and removal.

Another desirable feature of the illustrated systems 10 and 40 herein is that additional corrugation normal force, and/or additional feed wheel engagement normal force for more positive (non-slip) sheet feeding, is easily added at any time, and variably, at any desired point transverse the feed path, simply by dropping in an additional and/or more heavily weighted ball 24 and/or 30 into the open top of the particular vertical ball retaining tube for which additional normal force is desired. For example, this may be done to add more feeding force near one end or side of the paper path through the nips than the other, e.g., for oversize paper, or to add more corrugation centrally of a sheet than at the ends. Alternately, some or all of the balls 30 can be selectively removed to remove corrugating forces in selected areas.

To recapitulate, the balls 30, which are unsupported by the drive rollers 22 or 44, act as idlers which simply sit on the paper with gravity and freely roll around with little or no resistance as the paper goes through the nips. The vertical distance from the bottom of the balls 30 in their lowest position (defined by bottom retainers 32) to the tops of the feed rollers 22 or 44 is about 3 mm in this example. These idler balls are heavy enough that with most commonly run papers and transparencies, they will drop down almost this full 3 mm, thereby producing maximum corrugation and beam strength in the sheet. In contrast, when very stiff paper is going through, as in FIG. 3, the balls 30 will be pushed up by the sheet so that they are on virtually the same plane as the tops of the rollers 22 or 44. This will impart virtually no corrugation to the sheet. That is, the minimum corrugation plane is defined by the surfaces of the alternating adjacent drive rollers that the other (restrained) normal force balls 24 ride on. Thus, here the minimum sheet corrugation is approximately zero for very stiff papers, and the maximum corrugation is about 3 mm for most normal papers and transparencies, and varies for sheets varying therebetween in stiffness.

A particular advantage of this disclosed system is to improve feeding of transparencies or other difficult sheets into output or sorter trays with a simple and low cost modification of existing hardware. Existing nip hardware of foam rubber covered drive rollers, which drive against the underside of a copy sheet, and its drive motor system, may all be retained. However, prior noncorrugating exit nips are desirably replaced with this corrugating nip. Here, all top rollers are replaced with free floating balls. In existing nip configurations employing spring loaded idler rollers on drive rollers to define the nips to feed the copy sheets into the trays, these idler rollers and springs can be readily replaced with the subject balls-on-roller nips, plus the disclosed additional balls 30 added here to force the sheet down between each of the drive rollers for corrugating the sheet. All of the nip force is provided by the weight of the nip balls 24 against the drive rollers plus the weight of the additional unnipped balls 30 between each drive roller (which also corrugate the sheet). Yet, since all the balls are free to rotate in any direction, all axial resistance is eliminated, allowing even a corrugated sheet to offset as desired or intended. Corrugation here is only by freely vertically movable unsupported balls providing self-limiting sheet corrugators.

As noted, the solely balls-on-and-between-rollers system here also minimizes resistance to sheet lateral off-setting, which especially desirable in limited spaces or short feeding paths. By using free-rotating balls to provide both the nip force and corrugation, instead of rollers, offsetting sheets into sorter or other trays is greatly simplified. One such form of sheet offsetting, discussed above, can be provided by pivoting the drive rollers themselves relative to the paper path. This in turn drives the sheet forward but at a slight transverse angle, providing about, e.g., 25 mm of desired sheet offset. Another sheet offsetting technique is shifting the drive rollers axles axially, as shown in FIGS. 4 and 5 here, also discussed above. Adding idler rollers for corrugation would induce too much resistance or drag force on the sheet to this lateral sheet offsetting motion in any such system, and reduced offsetting to an unacceptable level (less than approximately 10 mm).

The present system virtually eliminates lateral resistance during feed wheel offsetting, and may also somewhat reduce feed nip resistance to corrugating compared to idler rollers defining the nips. That is, the ball-/nip decrease in lateral sheet movement resistance vis a vis idler roller nips can be desirable just for corrugating, since even corrugating without side shifting may require some lateral movement of parts of the sheet, especially at the outer feed nips. The corrugation itself "shrinks" the effective transverse sheet dimension to some extent, i.e., the relative width of the sheet changes slightly with corrugation. Thus, substantial sheet corrugation itself may require, or be enabled by, some lateral movement of the sheet in the feeding nips, especially the outside-most nips. [Or, the feed rollers may also be designed to flex slightly during sheet corrguation.] However, the frictional surface of the feed wheels themselves, and their transverse spacing, will prevent undesired lateral sheet movement or skewing.

Another significant advantage and feature of the disclosed system is that it also allows job set ejection of stapled or unstapled sets of plural sheets from an upstream set compiler via the same feed nip. These thick sets cannot be corrugated, and thus heretofore were not appropriate for feeding or ejecting via a feeder nip optimized for feeding thin single sheets with corrugation.

While the embodiment disclosed herein is preferred, it will be appreciated from this teaching that various alternatives, modifications, variations or improvements therein may be made by those skilled in the art, which are intended to be encompassed by the following claims:

What is claimed is:

1. An improved sheet feeding and corrugating system for image substrate sheets of a reproduction apparatus, wherein the sheets are fed in a normal path through a sheet feeding nip comprising plural, spaced, sheet feeding rollers, the improvement for both feeding and variably corrugating flimsy or stiff sheets comprising:

spherical balls freely mounted in generally vertical ball retainers providing for vertical movement and dual axis rotation against said sheet feeding rollers to define said sheet feeding nip;

additional spherical balls in additional generally vertical ball retainers positioned intermediately of said sheet feeding rollers for engagement of a sheet in said nip with said additional balls;

said additional spherical balls being unsupported vertically except by said additional ball retainers having bottom retainers preventing said additional balls from dropping fully out of the bottom of said additional ball retainers, so that said unsupported additional balls are rolling gravity loaded by the weight of said additional balls against a sheet being fed through said sheet feeding nip to provide intermediate sheet corrugation forces with the extent of sheet corrugation varying automatically with the stiffness of the sheet being fed.

2. The sheet feeding and variable corrugating system of claim 1, wherein the maximum extent of sheet corrugation is limited by said bottom retainers, and wherein said additional balls mounted in said additional ball retainers are freely liftable therein up to substantially the level of said nip by stiff sheets resisting corrugation to provide self-limiting of stiffer sheets corrugation and no substantial resistance to sheet feeding.

3. The sheet feeding and variable corrugating system of claim 1, wherein said additional ball retainers provide for readily independently adding or removing said additional spherical balls therein, to independently increase or decrease the sheet corrugation force at those respective locations transverse said nip.

4. The sheet feeding and variable corrugating system of claim 1, further including a sheet side shifting mechanism for laterally offsetting the sheets from said normal path through said nip so as to eject the sheets from said nip offset from said normal path, comprising moving said sheet feeding rollers relative to said normal path without resistance from said spherical balls or said additional spherical balls, all of which balls roll freely laterally as well as rolling freely in said normal path direction.

5. The sheet feeding and variable corrugating system of claim 4, wherein the maximum extent of sheet corrugation is limited by said bottom retainers, and wherein said additional balls mounted in said additional ball retainers are freely liftable therein up to substantially the level of said nip by stiff sheets resisting corrugation to provide self-limiting of stiffer sheets corrugation and no substantial resistance to sheet feeding.

* * * * *